United States Patent [19]

Whittingham

[11] 4,278,471

[45] Jul. 14, 1981

[54] PROCESS FOR EXTRACTING SUGAR FROM CELLULOSE AND CELLULOSIC MATERIALS

[75] Inventor: Barron S. Whittingham, Los Angeles, Calif.

[73] Assignee: Carl Eugene Dedlow, Venice, Calif.

[21] Appl. No.: 82,159

[22] Filed: Oct. 5, 1979

[51] Int. Cl.[3] ..... C13K 1/02

[52] U.S. Cl. ..... 127/37

[58] Field of Search ..... 127/37; 162/4, 5, 7, 162/14, 64, 84, 85

[56] References Cited

U.S. PATENT DOCUMENTS

| | | | |
|---|---|---|---|
| 1,428,217 | 9/1922 | Classen | 127/37 |
| 1,936,190 | 11/1933 | Dreyfus | 127/37 |
| 3,620,909 | 11/1971 | Gleason | 162/4 |
| 3,718,504 | 2/1973 | Whittingham | 127/37 |

*Primary Examiner*—Michael S. Marcus

*Attorney, Agent, or Firm*—Keith D. Beecher

[57] ABSTRACT

A process for producing glucose, which may be fermented into alcohol, from wood pulp cellulose. The wood pulp is produced by dispersing corrugated paper obtained, for example, from used cardboard boxes; or paper derived, for example, from used newspapers; or waste wood; as free fibers into water at ambient temperature, and by subsequently reducing the fibers to glucose by catalytic reduction and acid hydrolysis under heat and variable pressures.

4 Claims, No Drawings

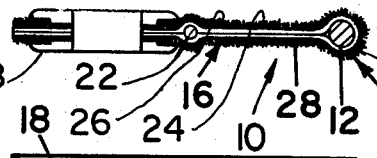
Fig. 2
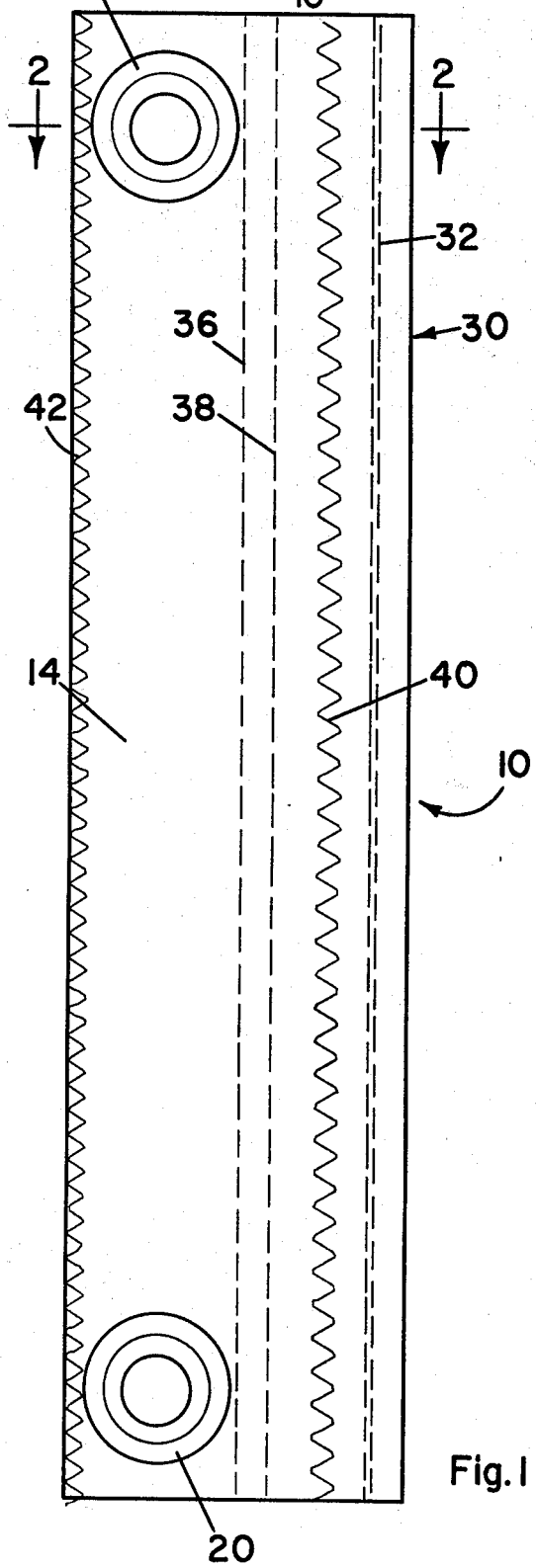
Fig. 1
Fig. 3a
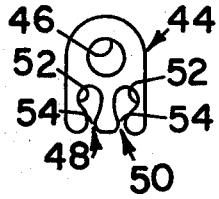
Fig. 3b
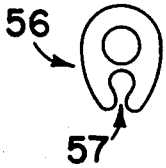
Fig. 3c
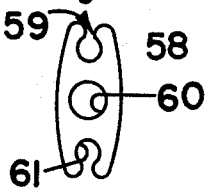
Fig. 3d
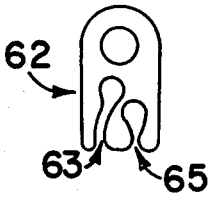
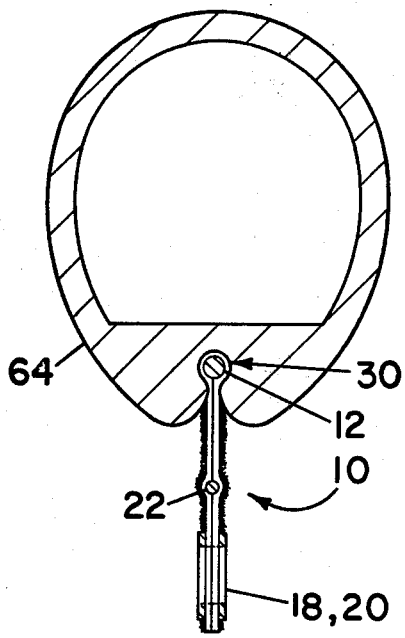
Fig. 4

METHOD AND APPARATUS FOR CLEANING SAILBOAT BOLT LINE TRACKS

BACKGROUND OF THE INVENTION

1. Field of the Invention

The present invention relates to devices and methods for cleaning sailboat bolt line tracks.

2. Description of the Prior Art

Heretofore no implement has been available which is suitable for cleaning sailboat bolt line tracks. Such tracks are configured as grooves with overhanging edges in the structure of a sailboat mast, boom or headsail foil. A bolt line track entraps the bolt line of a sail therein to secure the sail to the track and to prevent the bolt line of the luff or foot of a sail from being pulled laterally out of the track. The bolt line of the sail can be removed from the bolt line track by moving the bolt line to an open end of the track near the deck and extracting it therefrom.

Bolt line tracks are used in a number of locations on a sailboat. Bolt line tracks may be used on the main mast, the boom, or on the mizzen mast. Bolt lines are also used in grooved stay systems, such as those which employ foils. Such grooved systems are to be found on the head stay, as well as the baby or jack stay. The breadth and depth of the bolt line track varies with the size of the yacht.

During use of a yacht various deposits builds up in the bolt line tracks. Salt, grease, dirt and other material enter the bolt line track and ultimately become heavy enough to interfere with longitudinal movement of the sail along the bolt line track. In the past bolt line tracks on sailboats have been cleaned inadequately and only with considerable difficulty using brushes and rags. Such cleaning articles are not suitable for cleaning a bolt line track, however, and simply do not extend into the bolt line track to sufficiently scour the interior surface thereof. In particular such cleaning fails to fully remove deposits on the undersides of the overhanging lips. This is quite unfortunate since material buildups in this area interact with the wrinkles present in the sail at the bolt line thereof as the sail luff or foot is drawn along the bolt line track. Because of the inadequate cleaning means currently available, maintenance in cleaning bolt line tracks has been both infrequent and relatively ineffective.

SUMMARY OF THE INVENTION

The present invention is a cleaning implement and a method of cleaning bolt line tracks in a sailboat. The implement is formed of a stiff, nappy fabric covered core configured for insertion into a bolt line track. The track insertion core has a narrower skirt secured thereto. Longitudinally separated grommets are defined in the skirt. A halyard or other line may be secured to one grommet, and a tag line, or trailing line may be secured to the other grommet. The lines are worked together to reciprocally move the cleaning implement along the bolt line track to dislodge material therefrom. The cleaning implement may be inserted in the groove of a headstay foil, for example, and hoisted to the top of the headstay while the tag line is played out. The tag line and headsail halyard are worked together to longitudinally move the cleaning implement within the bolt line track to remove salt, grease, oil and other deposits of material which tend to build up in bolt line tracks. The fabric on the stiff core both dislodges the material to be removed and carries the material out of the track when the cleaning implement is withdrawn. If the material build up is stubborn and difficult to remove, the fabric may be saturated with a cleaning agent to ensure thorough cleaning. A lubricant may also be applied to the fabric to lubricate the track as the cleaning implement of the invention is drawn therealong.

The cleaning implement of the invention and the use thereof for cleaning bolt line tracks in a sailboat can be described with greater clarity and particularity by reference to the accompanying drawings.

DESCRIPTION OF THE DRAWINGS

FIG. 1 is an elevational view of a cleaning implement according to the invention.

FIG. 2 is a sectional view taken along the lines 2—2 of FIG. 1.

FIG. 3*a* is a cross sectional view of one forestay bolt line track configuration which may be cleaned according to the invention.

FIG. 3*b* is a cross sectional view of another forestay bolt line track which may be cleaned according to the invention.

FIG. 3*c* is a sectional view of yet another forestay bolt line track.

FIG. 3*d* is a sectional view of still another forestay bolt line track.

FIG. 4 illustrates the manner in which the bolt line track of a mast or boom is cleaned according to the invention.

DESCRIPTION OF THE EMBODIMENT AND METHOD

FIGS. 1 and 2 illustrate an implement 10 for cleaning bolt line tracks in a sailboat. The cleaning implement 10 has a stiff elongated nylon track insertion core 12, which is of circular cross section as depicted in FIG. 2. The core 12 is covered on both sides with a layer 14 of a nappy fabric that envelopes a skirt 16 which is secured to the track insertion core 12. As illustrated in FIG. 1, longitudinally separated annular metal grommets 18 and 20 are located in the skirt 16. Overall, the cleaning implement may be from 10 to 12 inches in length and about $2\frac{1}{2}$ inches in width, although precise longitudinal dimensions are not critical and the transverse dimensions may vary with the bolt line track systems to be cleaned.

The skirt 16 with the track insertion core 12 entrapped therein is formed like a luff tape for a sail. That is, the skirt 16 is constructed with the insertion core 12 located at an edge and a parallel backing core 22, also formed of nylon, spaced about an inch away within the skirt 16. The cores 12 and 22 are entrapped in parallel disposition within a sheet 24 of dacron cloth, folded over in upper and lower layers 26 and 28 respectively, as depicted in FIG. 2, to form the skirt 16 with the insertion core 12 at an edge return indicated at 30. The layers 26 and 28 of the sheet 24 are glued together and sewn together between the cores 12 and 22 with stitching to immobilize the cores 12 and 22 within the cover 24.

Thereafter a layer of nappy fabric 14 is folded over the insertion core 12 and the skirt 16 so that the fleecy fabric faces outwardly from both sides at the end return 30 of the implement 10. The fabric 14 is thereby coextensive with the covering 24.

The insertion core 12 is laterally entrapped at the edge return 30 by a double line of stitching 32 that is parallel to and spaced from the edge return 30. The stitching 32 secures the fabric covering 14 snugly to the folded sheet 24 next to the insertion core 12. Separate parallel lines of stitching 36 and 38 are sewn along either side of the backing core 22 to laterally entrap and immobilize the backing core 22 therebetween. A row of zigzag stitching 40 extends longitudinally between the insertion core 12 and the backing core 22 to further secure the fabric sheet 14 to the dacron sheet 24.

By constructing the skirt 16 with glue between the layers 26 and 28 of the sheet 24, the portion of the cleaning implement 10 from the parallel insertion core 12 to the backing core 22 is quite stiff and therefore does not tend to buckle or fold as it passes longitudinally along a bolt line track in a sailboat. Nevertheless, the skirt 16 with the fabric layer 14 sewn thereto is sufficiently resilient to traverse minor bends in the bolt line tracks of a forestay foil, a boom or a mast.

The grommets 18 and 20 are located at the upper and lower extremities, respectively, of the cleaning implement 10. The grommets 18 and 20 are preferably formed of brass or stainless steel to withstand exposure in a marine environment. The grommets 18 and 20 are used as a means with which to attach lines to the cleaning implement 10 to move it back and forth in the bolt line tracks of a sailboat. The fabric layer 14 and the upper and lower layers 26 and 28 of the dacron sheet 24 are stitched together along their edges opposite the end return 30 by a zigzag line of stitching 42 as depicted in FIG. 1. The line of stitching 42 thereby holds the layer 26 and 28 of the dacron sheet 24 together and prevents the fabric layers 14 from separating therefrom.

A wide variety of fabrics are available to serve as the fabric layer 14. Among suitable cloths which can be used are terrycloth, cotton knit, jersey, velour, wool, flannel, corduroy fleece and velveteen, either cotton or synthetic, or blends of both. Numerous other cloths suitable for cleaning purposes may be utilized.

In using the bolt line track cleaning implement 10, the fabric layer 14 may be saturated with a cleaning agent, such as soap and water, acetone, or whatever cleaning solution is required to do a thorough job. If only a light dusting or cleaning of the bolt line track is necessary, the implement 10 may be used without a cleaning agent.

It may also be desirable to use the bolt line cleaning implement 10 of the invention as a means for applying a lubricant. For lubricating a grooved bolt line track system, the use of an all purpose dry lubricant such as a commercially available silicone spray is recommended.

To clean or lubricate according to the invention the cleaning implement 10 is first inserted into and engaged into a bolt line track. The edge return 30 extends into the track and the skirt 16 protrudes therefrom.

Bolt line tracks exist in a variety of configurations. For example, FIG. 3*a* illustrates a two groove system in which a metal or plastic forestay foil 44 is illustrated. The foil 44 is extruded or molded with a circular longitudinally extending aperture 46 therethrough, through which the forestay cable of the boat passes. A pair of grooves or bolt line tracks 48 and 50 are formed in the foil 44. Each of these bolt line tracks is formed with a relatively wide, bulbous track 52 which is open only at a relative narrow neck 54. The structure of the foil 44 overhangs the track 52 at the neck 54 so that a luff of a sail inserted therein cannot be pulled laterally from the track 52, since the bolt line of the sail will not pass through the narrow neck 54. The edge return 30 of the cleaning implement 10 is entrapped within a track 52 in the same fashion. As a consequence, the cleaning implement 10 can be worked longitudinally along the tracks 48 and 50, one after the other to clean any buildup therein. Cleaning progresses quite rapidly and thoroughly, and the overhanging lips of the foil 44 at the neck 54 may be cleaned much better than in conventional practice.

The foil 44 of FIG. 3*a* is designed to accomodate two head sails at the same time. An alternative foil 56 is depicted in FIG. 3*b*. The foil 56 has but a single longitudinally extending track 57 intended to accomodate a single headsail.

The foil 58 of FIG. 3*c* has a central longitudinally extending molded aperture 60 through which the forestay cable passes. The foil 58 is designed for use where head rigs are to be changed frequently and includes a pair of opposing tracks 59 and 61. The foil 62 of FIG. 3*d* is also designed for use to accomodate two head sails at the same time, and has offset longitudinally extending bolt line tracks 63 and 65 of different cross sectional configurations.

The use of the cleaning device 10 is depicted in FIG. 4. To clean or lubricate with the cleaning implement 10 a halyard is attached to either one of the grommets 18 or 20. A tag line is secured to the other grommet and is long enough to extend to the deck when the halyard is raised aloft. The cleaning implement 10 is first inserted in a track in a forestay foil, or into the bolt line track in a boom, or into the bolt line track of a mast 64 as illustrated in FIG. 4. The cleaning implement 10, when used to clean the mast track in the mast 64, is hoisted aloft while the tag line is played out. The cleaning implement 10 is lowered by pulling on the tag line while easing the halyard. Typically it is desirable to scrub the bolt line track by moving the halyard and tag line in opposite directions to reciprocate the cleaning implement 10 along the bolt line track in the mast 64. Reciprocal movement of the cleaning implement 10 along the bolt line track operates to scrub the track and dislodge material buildup therefrom.

It should be understood that the configuration and dimensions of the edge return 30 can be varied as appropriate to the particular configuration of bolt line track with which the cleaning implement is to be used. Accordingly, such features as the cross sectional size and geometry of the insertion core 12, the spacing between the insertion core 12 and the backing core 22, and other dimensions of the cleaning implement 10 may be varied as necessary. The present invention, therefore, is not limited to the particular embodiment of the device depicted nor to the particular uses described, but rather is defined by the scope of the claims appended thereto.

I claim:

1. A short implement for cleaning elongated bolt line tracks in a sailboat comprising an insertion core, a nappy fabric covering said insertion core, a rigid backing extending parallel to said insertion core, a flexible sheet folded in layers to define an edge return at which said insertion core is located and a skirt enveloping said rigid backing and narrower than said insertion core, means for immobilizing said insertion core and said rigid backing within said flexible sheet, and longitudinally separated grommets located in said skirt.

2. An implement according to claim 1 further characterized in that said backing includes a backing core spaced from and parallel to said insertion core, and said layers are stitched together to immobilize said cores within said flexible sheet.

3. An implement according to claim 2 further characterized in that said layers of said sheet are sewn together through said fabric covering surrounding said insertion core at said edge return, laterally entrapping said insertion core therein by a line of stitching parallel to and spaced from said edge return, and said backing core is laterally entrapped by parallel lines of stitching on either side thereof through said fabric covering and said layers of said sheet.

4. An implement according to claim 3 further characterized in that said layers of said sheet are glued together and sewn together between said cores.

5. An implement according to claim 2 further characterized in that said fabric covering is coextensive with said sheet.

6. A method of cleaning elongated bolt line tracks on a sailboat using a short cleaning implement having a nappy fabric covered track insertion core, a rigid backing extending parallel to said insertion core, a flexible sheet folded over to define an edge return at which said insertion core is located and a skirt narrower than said insertion core enveloping said rigid backing and in which longitudinally separated grommets are defined, and means for immobilizing said insertion core and said rigid backing within said flexible sheet, comprising engaging said fabric covered insertion core in a bolt line track and repetitively moving said implement reciprocally therealong within said track to dislodge material therefrom.

7. A method of cleaning bolt line tracks according to claim 6 further comprising securing a halyard to one of said grommets and securing a tag line to the other of said grommets and moving said halyard and said tag line in opposite directions to reciprocate said implement along said bolt line track.

8. A method according to claim 6 further comprising applying a cleaning agent to said implement before engaging said core in said track.

9. A method according to claim 6 further comprising applying a lubricating agent to said cleaning implement before engaging said core in said track.

* * * * *